United States Patent [19]

Kataoka et al.

[11] 4,050,547

[45] Sept. 27, 1977

[54] FLOOR CONTROLLER FOR AN ELEVATOR

[75] Inventors: Hiroyuki Kataoka; Seinosuke Yahiro; Kazuo Suzuki, all of Katsuta, Japan

[73] Assignee: Hitachi, Ltd., Japan

[21] Appl. No.: 663,252

[22] Filed: Mar. 3, 1976

[30] Foreign Application Priority Data

Mar. 5, 1975 Japan ..... 50-26000

[51] Int. Cl.[2] ..... B66B 1/52

[52] U.S. Cl. ..... 187/29 R

[58] Field of Search ..... 187/29

[56] References Cited

U.S. PATENT DOCUMENTS

| | | | |
|---|---|---|---|
| 3,685,618 | 8/1972 | Takahashi et al. | 187/29 |
| 3,707,206 | 12/1972 | Watanabe et al. | 187/29 |
| 3,814,215 | 6/1974 | Takahashi et al. | 187/29 |

*Primary Examiner*—Robert K. Schaefer
*Assistant Examiner*—W. E. Duncanson, Jr.
*Attorney, Agent, or Firm*—Craig & Antonelli

[57] ABSTRACT

An elevator system is provided with a floor controller for controlling the speed of a car. One typical form of floor controller is composed of a synchronizer operated on a reduced scale in synchronism with the movement of an elevator car, an advancer which moves in advance of the synchronizer and stops when it detects a call, and a difference detector which moves in accordance with the relative distance between the synchronizer and the advancer for controlling the running speed of the elevator car in accordance with its own position. When a call is generated, the advancer must be driven in advance of the synchronizer in the direction selected by a direction selector separately provided. For this purpose, an electric motor for driving the advancer is provided, but it need not drive the advancer directly. Since any one of the synchronizer, the advancer or the difference detector moves in accordance with the difference between the distances covered by the travelling of the others, the advancer can be moved indirectly by driving the difference detector. This simplifies both the construction of the elevator system and the control of the advance motor.

11 Claims, 4 Drawing Figures

FLOOR CONTROLLER FOR AN ELEVATOR

Figure 1:
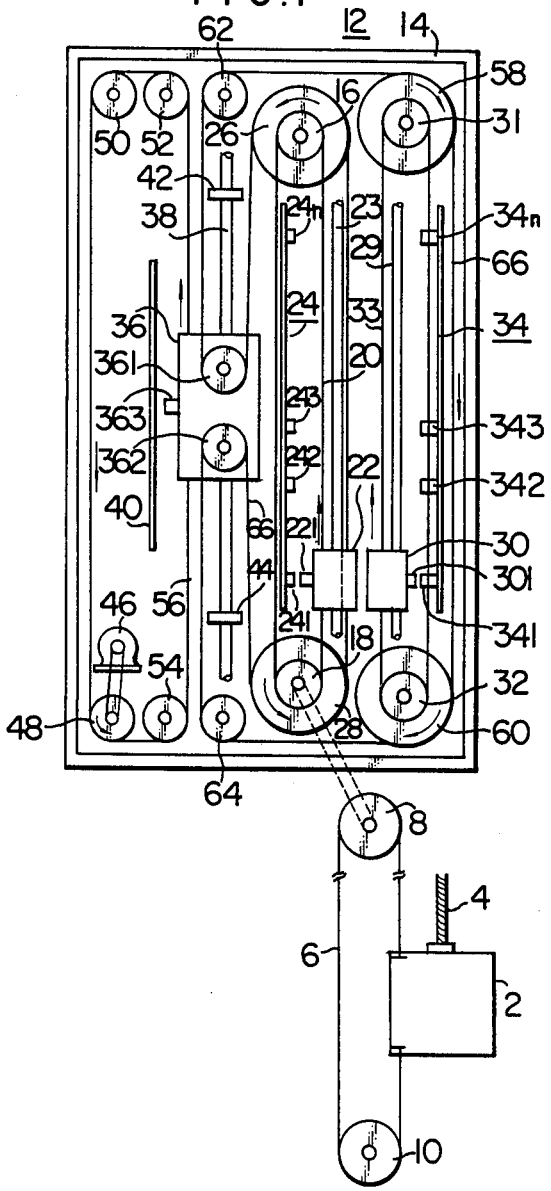

The present invention relates to an improvement in the floor controller provided for controlling the speed of an elevator car.

The floor controller, which is also called a floor selector, is installed in a machine room and has a mechanical construction simulating on a reduced scale the movement of an elevator car. It has functions to determine the running speed of the elevator car, to generate a speed command for deceleration and to generate a position signal for the elevator car.

Basically, the floor controller is composed of a synchronizer moving on a smaller scale in synchronism with the movement of the elevator car, and an advancer driven by driving means (hereinafter referred to as the "advancer motor") which moves in advance of the synchronizer and stops upon detection of a call. In order to determine the running speed of the elevator can and generate a speed command signal for decelerating and stopping the car at a call-generated floor, it is necessary to detect the relative distance between the synchronizer and the advancer.

It is well known that the advancer is so arranged as to move along a guide rail provided on the synchronizer and that the moving range of the advancer is limited by the length of the guide rail. (See U.S. Pat. No. 3,685,618.) The distance by which the advancer must lead the synchronizer is equal to the distance required for the elevator car running at a rated speed to decelerate and stop. This distance is hereinafter referred to as the "decelerating distance." The decelerating distance is proportional to the square of the elevator car speed. Therefore, when the elevator car is operated at high speed, the distance by which the advancer must lead the synchronizer greatly increases. The result is the requirement for a correspondingly longer guide rail and hence a larger synchronizer. This necessitates a larger floor controller which is so constructed as to move the synchronizer over a range covering all the floors in question.

On the other hand, taking note of the fact that the increased size of the floor controller is manily attributable to the advancer being moved on the synchronizer it was suggested that the advancer be moved independently of the synchronizer. (See U.S. patent application Ser. No. 600,055 filed on July 29, 1975.) In the suggested construction, the synchronizer, the advancer and the difference detector are moved along different and independent guide rails, and they are connected to each other by a differential system so that any one of them is moved in accordance with the difference between the distances covered by the travelling of the others. In the differential system an advancer motor for driving the advancer is mounted on the synchronizer since if the advancer motor is provided independently of the synchronizer, the speed control of the advancer motor becomes very difficult.

The last-mentioned construction, in spite of the advantage of facilitating the speed control of the advance motor, has a shortcoming in terms of mechanical construction in that the mechanism for transmitting the turning effort of the advancer motor mounted on the synchronizer to the advancer as a driving force is complicated. Also, the fact that the advancer motor is mounted on the synchronizer makes it difficult to reduce the size of the synchronizer sufficiently.

Accordingly, it is the primary object of the present invention to provide a simple mechanical construction of the floor controller for an elevator car reduced in size by the use of a differential system, in which the drive motor for the advancer can be easily controlled.

According to the present invention, there is provided a floor controller for an elevator car comprising a synchronizer moved on a reduced scale in synchronism with the movement of the elevator car, an advancer moved in advance of the synchronizer and stopped upon detection of a call and a difference detector movable according to the relative distance between the synchronizer and the advancer for controlling the running speed of the elevator can in accordance with the position thereof, the floor controller further comprising drive means for driving the difference detector in the direction selected at the time of generation of a call with the result that the advancer is moved in advancer of the synchronizer.

The synchronizer, the advancer and the difference detector are coupled with each other by means of a differential system and any one of them is movable only by the length equal to the difference between the lengths covered by the others. Also, the synchronizer is adapted to be moved only in accordance with the movement of the elevator car. In veiw of these facts, it will be understood that the advancer can be driven not directly but indirectly by driving the difference detector.

This configuration provides a floor controller for an elevator car simple in mechanical construction in which the advance motor can be controlled quite easily.

Figure 2A:
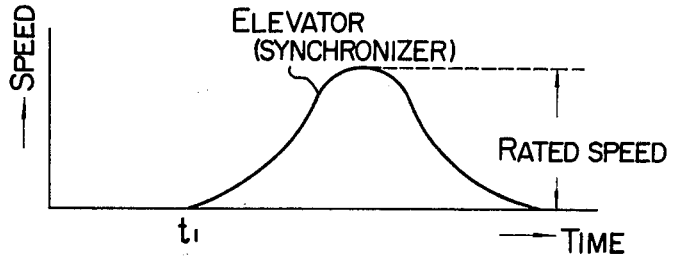
Figure 2B:
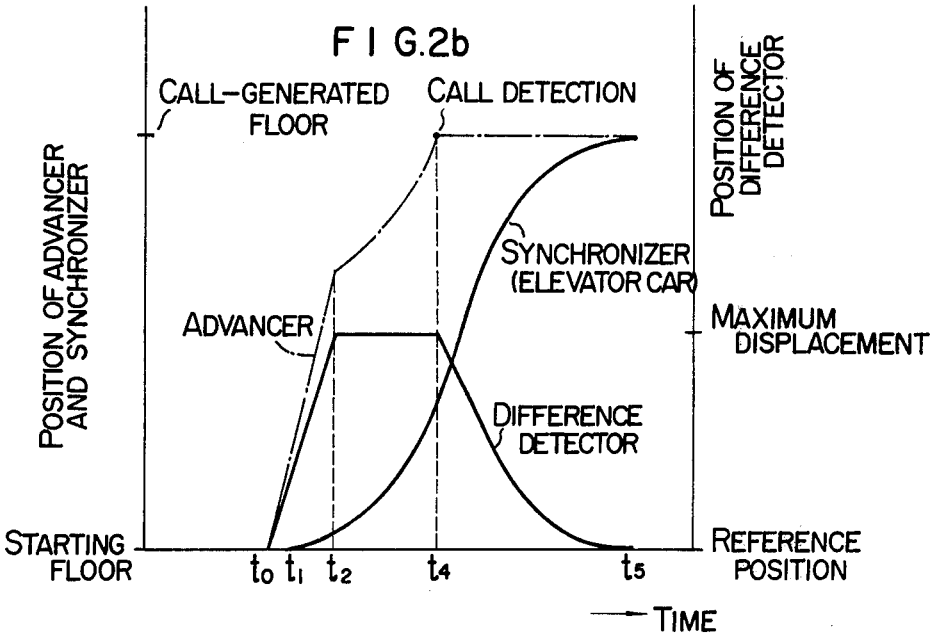
Figure 3:
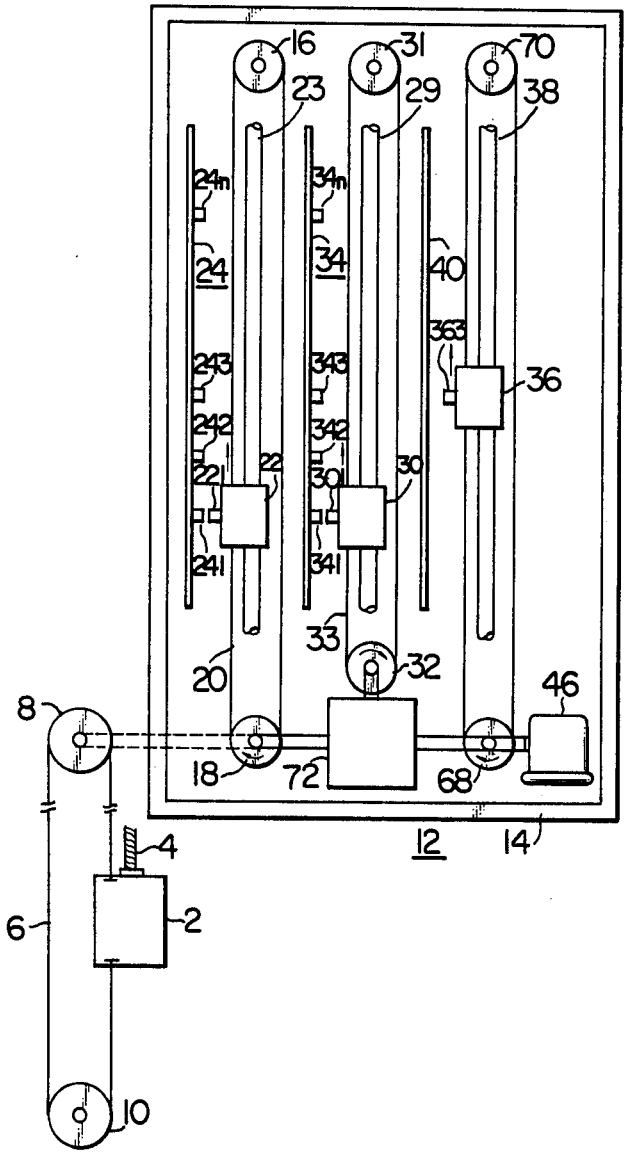

The above and other objects, features and advantages will be made apparent by the detailed description taken in conjunction with the accompanying drawings, in which:

FIG. 1 is a schematic diagram showing the construction of an embodiment of the floor controller for an elevator car according to the present invention;

FIG. 2*a* illustrates a curve showing the elevator car speed characteristics for explaining the operation of the floor controller according to the invention;

FIG. 2*b* is a diagram showing loci of the synchronizer, the advancer and the difference detector for explaining the operation of the floor controller according to the invention; and FIG. 3 is a schematic diagram showing the construction of another embodiment of the floor controller for an elevator car according to the invention.

First, an embodiment of the invention having a differential system composed of a combination of chains and sprockets will be explained with reference to FIG. 1. An elevator car 2 is hung by a rope 4 and driven up and down. Both ends of a steel tape 6 are fastened to the car 2 to form a loop between a couple of sprocket pulleys 8 and 10. The tape 6 has a plurality of holes formed therein equidistantly (not shown) for engaging with the pulleys. A floor controller 12 is disposed in a machine room situated upward and has a frame 14 which houses the operating parts mentioned below.

A chain 20 engages with a couple of sprocket pulleys 16 and 18. A synchronizer 22 movable up and down along a guide rail 23 is supported on the chain 20. The sprocket pulley 18 is driven by the sprocket pulley 8 through a reduction gearing (not shown). As a result, the synchronizer 22 is operated on a smaller scale in synchronism with the movement of the elevator car 2. An oscillator 221 is mounted on the synchronizer 22. A receiver 24 is disposed on the frame 14 opposedly to the oscillator 221. The receiver 24 is composed of receiving units 241, 242, 243, . . . 24*n* which correspond to the 1st, 2nd, 3rd, . . . , *n*-th floors respectively. Depending on the operation of these receiving units, the position of the elevator car at a given time may be detected.

Another couple of sprocket pulleys 26 and 28 of larger diameter are provided coaxially with the sprocket pulleys 16 and 18 respectively. An advancer 30, which is guided up and down along a guide rail 29, is mounted on an endless chain 33 which engages with a couple of sprocket pulleys 31 and 32. An oscillator 301 is mounted on the advancer 30. Oppositely to the oscillator 301, a receiver 34 is disposed on the frame 14. The receiver 34 is composed of a plurality of receiving units 341, 342, 343, . . . 34*n* which correspond to the 1st, 2nd, 3rd, . . ., *n*-th floors to which the elevator car travels to serve. The receiver 34 is disposed on the same scale as the above-mentioned receiver 24. A difference detector 36 has a couple of idle sprocket pulleys 361 and 362 mounted thereon and is movable up and down along a guide rail 38. The difference detector 36 carries an object of detection 363. Oppositely to the object of detection 363, a detector 40 is mounted on the frame 14. The detector 40 is for detecting the position of the difference detector 36 and for making use of the output signal thereof for elevator speed control.

The object 363 may take the form of the above-mentioned oscillator. In this case the detector 40 is composed of a plurality of receiving units arranged appropriately, so that the operation of each of the receiving units enables the position of the difference detector 36 to be detected digitally. In the event that the position of the difference detector 36 is desired to be detected in analog form, any of various well-known continuous detectors may be utilized. In order to restrict the range of movement of the difference detector 36, a couple of stoppers 42 and 44 may be provided on the frame 14, as will be explained later. The difference detector 36 may be driven directly by an advancer motor 46 secured on the frame 14. In detail, the advancer motor 46 drives a sprocket pulley 48 so as to cause the difference detector 35 to travel up and down by means of a chain 56 through three idle pulleys 50, 52 and 54.

Sprocket pulleys 58 and 60 of larger diameter are mounted on the same axis as the sprocket pulleys 31 and 32. Idle pulleys 62 and 64 are provided in addition to these sprocket pulleys 58 and 60. An endless chain 66 extends from the idle sprocket pulley 361 toward the idle sprocket pulley 62. Engaging with the idle sprocket pulley 62 the chain 66 bend right in the drawing and extends toward the sprocket pulley 58. The chain 66 engages with the sprocket pulley 58 and then further extends toward the sprocket pulley 60 to engage therewith. It further extends through the idle sprocket pulley 64 toward the idle sprocket pulley 362 mounted on the difference detector 36. Engaging with the idle sprocket pulley 362 the chain 66 extends in the reverse direction toward the sprocket pulley 28 to engage therewith. After the engagement with the sprocket pulley 28 the chain 66 reverses its travelling direction toward the sprocket pulley 16 and through the engagement with the sprocket pulley 16 returns to the starting point or the idle sprocket pulley 361 mounted on the difference detector 36.

The operation of the controller will be explained below.

Assume that the elevator car is waiting at the first floor. The synchronizer 22, the advancer 30 and the difference detector 36 stay at the reference positions shown in the drawing. If a hall call is generated from the third floor or a passenger who has taken the car registers a cage call for the third floor, then the third floor call is stored in an electric circuit (not shown) and the direction in which the elevator car should be operated is selected by the electric circuit. The advancer motor 46 is driven in the selected direction so as to rotate the sprocket pulley 48 in the direction of the arrow shown in the drawing. The difference detector 36 begins to move upward. At this time, if the elevator car is still stationary, the sprocket pulleys 26 and 28 are unable to rotate. As a result, the upward movement of the difference detector 36 causes the upward movement of the advancer 30 also.

Actually, however, when the direction of the elevator car travel is determined, the car begins to move in that direction, namely, upward in the case under consideration. The advancer 30 is therefore moved upward by both the advancer motor 46 and the synchronizer 22. In any case, the distance by which the advancer 30 is moved up by the advancer motor 46 is the distance by which the advancer 30 leads the synchronizer 22. In the same manner as in the known floor controllers, advancer 30 is required to be moved in such a manner as to look for a call in a range allowing the elevator car to decelerate and stop to successfully serve the call, and the acceleration of the advance motor is determined accordingly.

When the advancer 30 moving ahead reaches a position corresponding to the third-floor, the oscillator 301 is placed opposite to the receiving unit 343. The receiving unit 343 is actuated, so that supply of power to the advance motor 46 is stopped by an electric circuit (not shown), while the advancer 30 is held at the position corresponding to the 3rd-floor by an engaging means (not shown), like the known floor controllers.

In the mean time, the difference detector 36 is moved up by the differential system composed of a combination of the chain and the sprockets by the distance corresponding to the positional interval between the advancer 30 and the synchronizer 22. Therefore, by detecting the position of the difference detector 36, it is possible to determine the maximum speed at which the car is allowed to run at that very moment.

After that, the elevator car continues to move up and therefore the synchronizer 22 also moves up under the condition that the power supply for the advancer motor 46 is cut off and the advancer is in a locked state. The difference detector 35 begins to move back toward the shown reference position from the upper position it had reached, by the action of the differential system. When the synchronizer 22 reaches a position corresponding to that of the advancer 30, namely when the elevator car reaches the 3rd floor, the difference detector 36 arrives at the shown reference position. It has already been mentioned that the difference detector 36 has been displaced from the shown reference position by the distance corresponding to the relative distance between the synchronizer 22 and the advancer 30. Therefore, a speed command for the deceleration of the car may be produced from the position-detecting signal for the difference detector 36. When the elevator car is decelerated in response to this speed command and the synchronizer 22 reaches a position opposed to the receiving unit 243 which is located at a position corresponding to the 3rd floor, the elevator car comes to a stop. In otherwords, the synchronizer 22 and the advancer 30 stop at the respective positions each corresponding to the 3rd-floor, while the difference detector 36 stops at the shown reference position.

Next, explanation will be made about the case in which the elevator car is often engaged in a steady long-distance operation at a rated speed. Reference is made to FIGS. 2*a* and 2*b*.

As is well known, it is only during the operation covering a considerably long distance that an elevator car is able to run at its rated speed. In the explanation that follows, it is assumed that there is a period of time during which the elevator may run sometime at its rated speed when it travels from the 1st floor to the *n*-th floor in FIG. 1.

Suppose that the elevator car 2 waits at the 1st floor and that a hall call from the *n*-th floor is produced or a cage call for the *n*-th floor is generated by a passenger who is in the car 2. As explained already, the advancer 30 begins to move in advance of the synchronizer 22 at the time point $t_0$ and searches for the call, followed by the upward movement of the synchronizer 22 synchronized with the movement of the elevator car, which upward movement starts at time point $t_1$. Since there is no call generated at the floors nearer than the *n*-th floor, it takes a while before the advancer 300 finds a call while moving up and the relative distance between the advancer 30 and the synchronizer 22 is thus widened greatly until at time point $t_2$ the maximum displacement of the difference detector 36 is detected by the position detector 40. If the advancer 30 is allowed to lead the synchronizer 22 any further, the chance is that a call, if detected, cannot be served. To prevent such as inconvenience, the detection of the maximum displacement of the difference detector by the detector 40 causes the advancer motor 46 to be locked. In the case where a DC motor is used as the advancer motor 46, for example, the ends of the armature winding may be short-circuited to produce a dynamic braking torque. Accordingly, the difference detector 36 is stopped at the position associated with the maximum displacement. The elevator car, namely the synchronizer 22, is still being accelerated, however, and then the advancer 30 moves at the same speed as the synchronizer 22. In other words, during the time period from the time points $t_2$ to $t_4$ in FIG. 2*b*, the loci of the synchronizer 22 and the advancer 30 are in parallel with each other. If the advancer 3 reaches the position corresponding to the *n*-th floor (the call-generated floor) and detects the call at time point $t_4$, a locking device engages and stops the advancer 30. After this time point, the advancer 30 remains stationary at the position corresponding to the *n*-th floor.

In response to the above-mentioned call detection signal, the advancer motor 46 is unlocked and thereafter the difference detector 36 is moved down by the upward movement of the synchronizer 22. At time point $t_5$, the synchronizer 22 reaches and stops at the position corresponding to the *n*-th floor, while the difference detector 36 returns to and stops at the reference position shown in FIG. 1. As a result, the elevator car completes its operation from the 1st to the *n*-th floors in accordance with the speed characteristics curve as shown in FIG. 2*a*.

In this way, it is possible to obtain a floor controller for an elevator car which is simple in over-all construction without any complicated mechanism having the advancer motor 46 mounted on the synchronizer 22.

Also, the advancer motor 46 is controlled very easily as it is subjected to a linear acceleration control during the period of time from $t_0$ to $t_2$ in FIG. 2*b*, is locked (for instance, by dynamic braking of a DC motor) during the time $t_2$ to $t_4$, and requires no control during the time period from $t_4$ to $t_5$. In other words, if the advancer 30 is driven directly by the advancer 46, it is difficult to effect speed control in such a manner that the advancer 30 is moved in parallel to the synchronizer 22 during the time period from $t_2$ to $t_4$.

The above-described embodiment employs a differential system composed of the sprocket pulleys 26 and 28 rotatable in proportion to the movement of the synchronizer 22, the sprocket 58 and 60 rotatable in proportion to the movement of the advancer 30, the idle sprocket pulleys 361 and 362 mounted on the difference detector 36, the idle sprocket pulleys 62 and 64, and the endless chain 66 which engages with these pulleys 36, 28, 58, 60, 361, 362, 62 and 64. Such a differential system composed of a combination of the chain and the sprockets has the advantage of a comparatively low cost.

Even though the above-mentioned embodiment is so arranged that the synchronizer 22 and the advancer 30 are supported on the endless chains 20 and 33 respectively but not on the endless chain 66 making up the differential system, it will be easily understood that they may be supported directly on the endless chain 66 basically. In spite of this, it is advisable to provide separate sprockets and chain for supporting the synchronizer 22 and the advancer 30, as in the above described embodiment, in order to make possible travel of the same direction of the synchronizer 22, the advancer 30 and the difference detector 36 and to facilitate the maintenance and adjustment. To achieve this purpose, it is not absolutely necessary to provide different sprockets and chains for the synchronizer 22 and for the advancer 30 respectively, but the synchronizer 22 may be supported on the endless chain 66 connecting the sprockets 26 and 28 in FIG. 1. The reason why the synchronizer 22 and the advancer 30 are supported on the separate chains 20; 30, separate sprockets 16; 18 and 31; 32 in the above-described embodiment is to enlarge the range of movement of the difference detector 36 to secure a more precise speed command for deceleration.

In other words, by increasing the diameter of the sprockets 26, 28, 58 and 60 as compared with those of the sprockets 16, 18, 31 and 32, the movement of the difference detector 36 can be magnified in relation to that of the synchronizer 22 and the advancer 30. In the embodiment of FIGS. 1, 2*a* and 2*b*, the movement of the difference detector 36 is twice as large as that of the synchronizer 22 and the advancer 30.

Referring again to FIG. 1, the stoppers 42 and 44 are shown which block the movement of the difference detector 36 at the positions associated with the upward and downward maximum displacements of the difference detector 36. The provision of the stoppers 42 and 44 enables the difference detector 36 to stop at either position of maximum displacement at time $t_2$ without fail. During the time period from $t_2$ to $t_4$, the advancer motor 46 may be given a slight turning effort without being locked.

Although the foregoing description is concerned with the configuration using the chains and the sprockets, the idle sprocket pulleys 50, 52, 54, 62, 64, 361 and 362 may be replaced by mere rollers. Also, instead of the chains and sprockets, simple ropes and rollers may be employed as far as slip-preventing measures are available.

One priciple of the differential system constituted by a combination of chain and sprocket is that by connecting the both ends of a chain which is engaged with an idle sprocket pulley provided on the difference detector to the synchronizer and the advancer respectively through further idle sprocket pulleys, such an arrangement as to move the difference detector, the synchronizer and the advancer in the vertical direction, for example, may be obtained. By means of the thus arranged differential system, the difference detector may be moved in accordance with the difference between the respective displacement distances of the synchronizer and the advancer.

However, there is such a problem of accuracy in the thus arranged system that in order to prevent any error from occurring among the difference detector, the synchronizer and the advancer it is necessary to give proper tension to the advancer and the difference detector such that they are urged to move in one direction.

For this reason, as in the above-mentioned embodiment, by restricting the differential displacements among the synchronizer, the advancer and the difference detector by using the chain in an endless mode and by providing all the idle sprocket pulleys in couple, such a differential system that is strong in construction and high in accuracy can be realized.

Another embodiment of the invention employing a differential gear as the differential system is shown in FIG. 3. The sprocket pulleys 48 and 54 in FIG. 1 are replaced by a sprocket pulley 68 and the sprocket pulleys 50 and 52 by the sprocket pulley 70. A differential gear 72 is provided for coupling the synchronizer 22, the advancer 30 and the difference detector 36 to each other. As to the other parts, like component parts are shown by like reference numerals as in FIG. 1.

It will also be easily seen that, by designing the internal construction of the differential gear 72 suitably, the direction of movement of the synchronizer 22, the advancer 30 and the difference detector 36 may be rendered coincident and the distances covered by them adjusted.

This construction attains, in addition to the same advantages as the embodiment of FIG. 1, the convenience of maintenance and adjustments because of the simplification of visible parts.

What is claimed is:

1. A floor controller for an elevator car serving a plurality of floors comprising:

a sychronizer which is movable on a reduced scale in synchronism with the movement of the elevator car;

an advancer which is movable in advance of said synchronizer for detecting a call, said advancer being stopped upon detection of a call;

a difference detector;

a differential system for moving said difference detector in accordance with the relative distance between said sychronizer and said advancer;

first means for controlling the running speed of said elevator car in accordance with the position of said difference detector; and second means for driving said difference detector in a selected direction at the time of generation of a call so that said advancer is moved in advance of said synchronizer.

2. A floor controller according to claim 1, comprising third means for stopping said difference detector upon detection of a maximum displacement of said difference detector which maximum displacement corresponds to the decelerating distance of said elevator car running at its rated speed.

3. A floor controller according to claim 2, in which said third means includes fourth means for electrically locking said driving means.

4. A floor controller according to claim 3, in which said second means includes a DC motor and said fourth means includes fifth means for short-circuiting the ends of the armature circuit of said DC motor.

5. A floor controller according to claim 2, in which said third means includes mechanical stopper means.

6. A floor controller according to claim 5, in which said mechanical topper means is disposed at a position associated with the maximum displacement of said difference detector, and said floor controller further comprises sixth means for causing said second means to continue to produce a comparatively small driving force during a period of time from the arrival of said difference detector at the position associated with the maximum displacement to the detection of a call by said advancer.

7. A floor controller according to claim 1, in which said differential system includes a combination of chain means and sprocket means for connecting said synchronizer, said advancer and said difference detector to one another.

8. A floor controller according to claim 1, in which said differential system includes at least one idle sprocket pulley mounted on said difference detector, and a first chain means engaging with said at least one idle sprocket pulley and coupled with said synchronizer and said advancer.

9. A floor controller according to claim 8, in which said differential system includes a first sprocket pulley means engaging with said first chain, a second sprocket pulley means provided coaxially with said first sprocket pulley means respectively, and a second chain means engaging with said second sprocket pulley means, at least one of said synchronizer and said advancer being attached to a part of said second chain means, said differential system being so arranged that said sychronizer, said advancer and said difference detector are movable in the same direction.

10. A floor controller according to claim 8, in which said differential system includes two combinations of chain and sprocket means, each of said two combinations including a first sprocket pulley means engaging with said first chain means, a second sprocket pulley means provided coaxially on said first sprocket pulley means and being smaller in diameter, and a second chain means engaging with said second sprocket pulley means, said synchronizer and said advancer beig attached to said respective second chain means of said two combinations of chain and sprocket means, said differential system being so arranged that the displacement of said difference detector is magnified.

11. A floor controller according to claim 8, in which said differential system includes a differential gear means.

* * * * *